United States Patent [19]

Skokos et al.

[11] Patent Number: 4,638,940

[45] Date of Patent: Jan. 27, 1987

[54] COMBINED FORM FOR VISUAL MATTER, WRITTEN DESCRIPTIONS AND MAILING ENVELOPES

[76] Inventors: Peter G. Skokos, 902 Fletcher Lake, Bradley Beach, N.J. 07720; Alvin A. Sobel, 577 Paramus Rd., Paramus, N.J. 07652

[21] Appl. No.: 469,001

[22] Filed: Feb. 23, 1983

[51] Int. Cl.[4] ..... B65D 27/04; B65D 27/06

[52] U.S. Cl. ..... 229/92.3; 229/72; 229/73

[58] Field of Search ..... 229/92.3, 73, 72

[56] References Cited

U.S. PATENT DOCUMENTS

| | | | |
|---|---|---|---|
| 3,111,336 | 11/1963 | Schumacher | 229/73 |
| 3,315,878 | 4/1967 | Hiersteiner | 229/72 |
| 3,833,167 | 9/1974 | Kapitan | 229/73 |
| 4,008,852 | 2/1977 | Davis | 229/92.3 |
| 4,508,224 | 4/1985 | Weber et al. | 229/72 |

*Primary Examiner*—Stephen P. Garbe

*Attorney, Agent, or Firm*—Lieberman, Rudolph & Nowak

[57] ABSTRACT

A business form combining the storage and organization of visual matter such as photographs on diagrams with corresponding written descriptions and two mailing envelopes formed from a single sheet folded to form three (3) panels. The first panel has see-through plastic overlay attached to the underlying sheet with an adhesive, forming compartments initially sealed on three (3) sides permitting insertion of the visual matter into the compartment and ultimately sealing of the fourth side by exposing an adhesive surface. On the reverse side of the first panel is an envelope face. The second panel in both sides of the sheet provides space for written descriptions corresponding to the visual matter. The third detachable panel provides space for written directions on use of the form and on the reverse side an envelope face.

6 Claims, 5 Drawing Figures

COMBINED FORM FOR VISUAL MATTER, WRITTEN DESCRIPTIONS AND MAILING ENVELOPES

BACKGROUND OF THE INVENTION

This invention generally relates to business forms which combine panels for exposing, storing and organizing visual matter such as photographs or diagrams with written descriptions corresponding to the visual matter and mailing envelopes. Such forms are particularly useful where visual matter and corresponding written descriptions are mailed from one party to another and where the form and subject matter are to be filed for future reference.

Numerous forms for magazines and books are known. Many of these combine space for written information and provision for mail responses. Some of the forms provide for various types of envelopes which may be detached from the form for the purpose of responding to the information on the form or as an acknowledgement of receipt. Such forms are described in Simson U.S. Pat. No. 4,011,985 issued Mar. 15, 1977, and Quincey U.S. Pat. No. 411,057 issued Sept. 17, 1889.

Many of the prior art forms are complex in construction and thus have a high cost of manufacture. For the most part the prior art forms only provide space for written matter and a reply card or detachable envelope with the form. Also known are forms wherein a single sheet is foldcd upon itself providing a detachable envelope, a window for exposing information and a flap for storage.

The business form of the present invention is particularly useful in the insurance, real estate or medical fields. For example, in the insurance business when an insured has a property loss it is necessary for the insured to send photographs of the damaged property to the insurer. Presently, the claimant sends photographs with a written description of the damaged property on the backside of the photograph. Frequently, the photographs are sent loose in an envelope, i.e., unattached to any paper or form, providing no means for organizing or filing and making the photographs susceptible to loss.

The present invention discloses a simple and economical construction wherein a single sheet forms three (3) panels wherein the first panel with a seethrough plastic overlay provides for the storage and organization of visual matter and on the reverse side an envelope face, the second panel provides space for corresponding written description and the third panel provides space for written directions on the use of the form and on the reverse side an envelope face.

SUMMARY OF THE INVENTION

It is an object of the present invention to provide a form of the type described herein which is simple in construction and economical to manufacture.

It is another object of the present invention to provide a means of organizing a convenient easy-to-use manner, visual matter with a written description or comment about said visual representation which can then be mailed in an envelope comprising the form using adhesives.

It is still a further object of the invention to provide a compartment for inserting visual matter, i.e., a photograph, chart or diagram which permits viewing of said visual matter which preserves the visual matter so that it may be available for future reference.

An additional object of this invention is to provide a space for a written description or comment pertaining to the visual representation.

Still another object is to provide a means for mailing the form without undue effort or cost by structuring the form so that two envelopes are formed by merely folding the form and securing the appropriate edges of the form through the use of adhesive.

Accordingly, it is a general object of the present invention to provide a business form which combines space for visual matter such as photographs or diagrams and corresponding written descriptions with mailing envelopes.

The above, as well as other objects and advantages of the invention will become apparent from the following detailed description, reference being made to the accompanying drawings.

DESCRIPTION OF THE PREFERRED EMBODIMENT

The present invention is for a business form and a sheet for making the form. The business form, in accordance with the present invention, comprises a generally rectangular form of essentially three panels. The three panels are essentially equal in dimension, each panel having a front and rear surface. The front surface of the first panel has an overlying see-through plastic surface attached by adhesive. See-through compartments with one open edge permit insertion of visual matter and then securing of the visual matter by sealing the see-through plastic overlay to the underlying sheet at the open edge. On the rear surface of the first panel is an envelope face. The second panel is separated from the first panel by a fold line and from the third panel by a perforated fold line. The front and rear surface of the second panel provides a space for a written description corresponding to the visual matter stored in the first panel. Adjacent to the perforated fold line between the second and third panels is an adhesive surface covered by a plastic overlay which is readily removable so as to expose the adhesive surface. The front furface of the third panel provides a space for written directions on use of the form and on the rear surface an envelope face.

The sheet of the invention comprises a generally rectangular sheet of flexible eighty (80) lb. weight paper which sheet is arbitrarily divided by two fold lines dividing said sheet into three (3) panels. The first fold line defines the first and second panels. Adhesive surfaces applied to the sheet on the edges of the first panel provide a means for attaching the see-through plastic overlay to the sheet. The second fold line is a perforated line adjacent to which on the second panel is an adhesive surface covered by a plastic overlay. Adjacent to the outermost edge of the third panel is an adhesive surface covered by a plastic overlay. Folding the first panel along the fold line so as to bring the first and second panels into coextensive relation and then the third panel along the second fold line so as to bring the front surface of the third panel into coextensive relation with the rear surface of the first panel causes the entire form to the formed into an envelope which can be sealed by exposing the adhesive surface on the third panel. Upon receipt of the form the envelope is opened by cutting along a perforated line near the outermost edge of the rear surface of the third panel. The third panel is detachable along the perforated line between the second and third panels. A second envelope is formed by folding along the fold line between the first and second panels and securing said panels by exposure of an adhesive surface on the second panel adjacent to the edge of the second panel where the second fold line had been.

Figure 1:
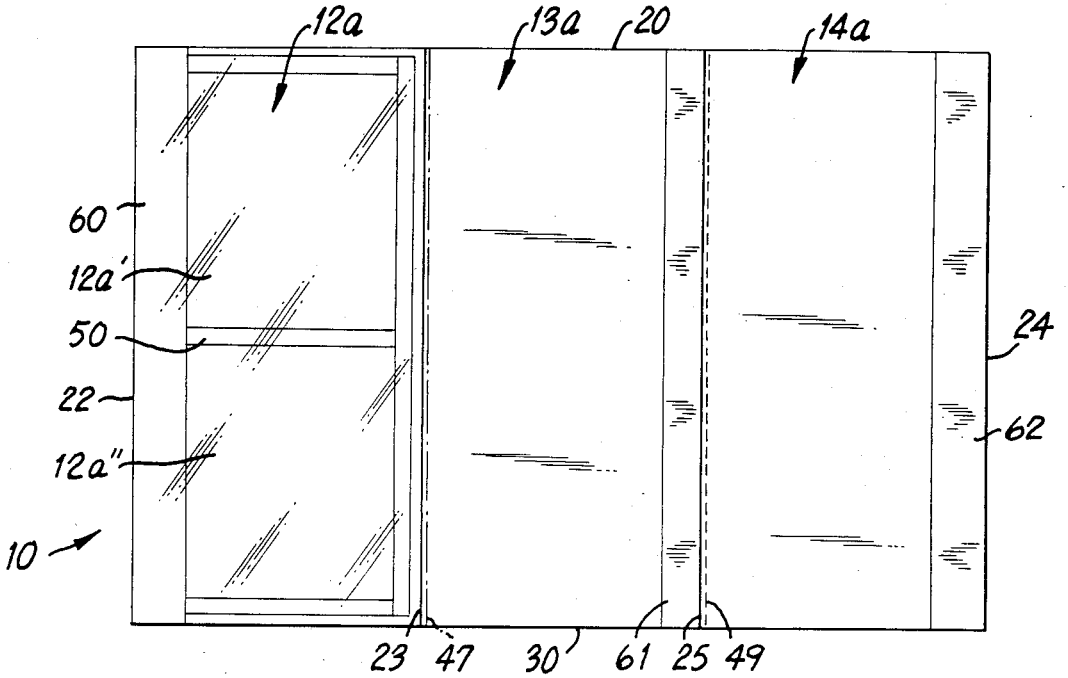
FIG. 1 is a front surface representation of the form in accordance with the present invention of a sheet with two fold lines forming three panels one panel with an overlying see-through plastic surface for storing and organizing visual matter.

Referring now specifically to the figures, wherein identical or similar parts are designated by the same reference numerals throughout, and first referring to FIG. 1, there is shown an insurance form, 10. The specific dimensions of the form are not critical, since the visual display portion of the form may be variously shaped and dimensioned. The insurance form 10 to be described by way of example, is made from an initial sheet which is approximately eleven (11) inches by thirteen and one-half (13.50) inches. The initial sheet is rectangular and has an upper edge 20 and a lower edge 30, as viewed in FIG. 1. Once the form is prepared, there is defined a left-hand edge 22 and a right-hand edge 24.

The form 10 in FIG. 1 includes three (3) panels, 12*a*–12*b*, 13*a*–13*b* and 14*a*–14*b*. Panels 12*a*, 13*a* and 14*a* shall be referred to as front panels for reference purposes while 12*b*, 13*b* and 14*b* are the respective rear panels. The front panels 12*a*, 13*a* and 14*a* have idential dimensions to the respective rear panels 12*b*, 13*b* and 14*b*. The fold lines 23 and 25 are parallel to the edges 22 and 24.

Figure 2:
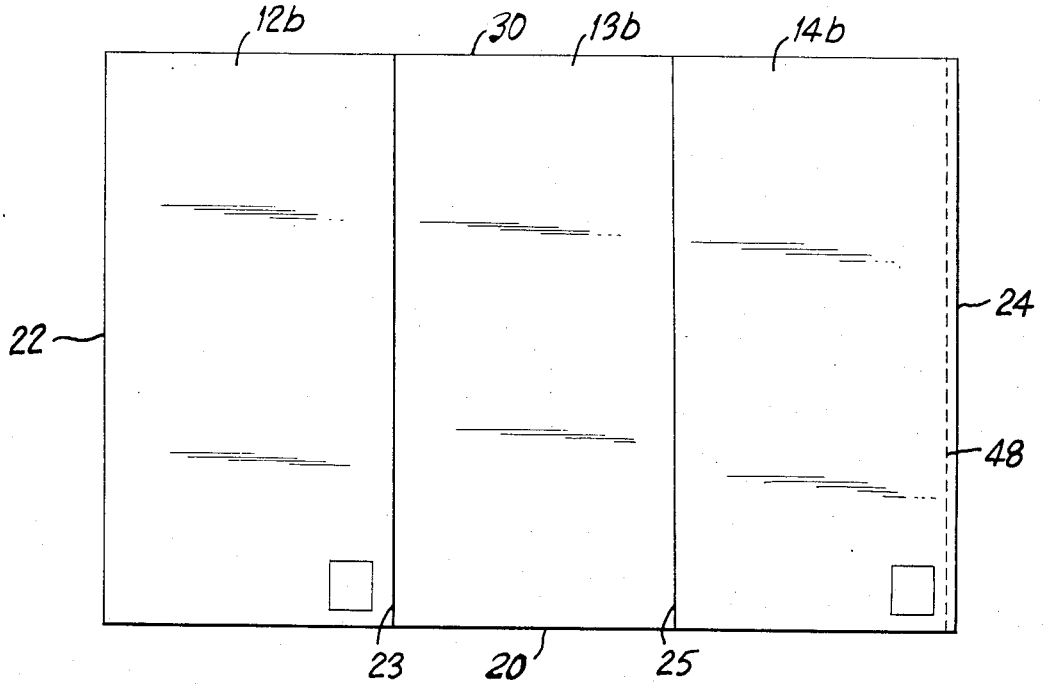
FIG. 2 is a rear view of the form showing the two envelope faces and a space for additional written descriptions or comments.

Panel 12*a*–12*b* comprises the panel for securing the visual matter, i.e., photograph or diagram on 12*a* and an envelope face on 12*b*. Panel 12*a* is bound by top edge 20, bottom edge 30, left edge 22 and fold line 23. An important feature of the present invention is the formation of compartments formed by a see-through plastic overlay secured to the underlying sheet by adhesive surfaces adjacent to the respective edges 20, 30 and 23. Adjacent to the left edge 22 is an adhesive surface over which lies a removable plastic sheet 60 which prevents adhesion of the left edge of the see-through plastic overlay to the left edge of the underlying sheet. Near the middle of the visual matter panel 12*a* running from the left edge 22 to the fold line 23 and perpendicular to those respective edges is a narrow adhesive strip 50. This narrow adhesive strip 50 divides the visual matter panel into two compartments 12*a*′ and 12*a*″. The adhesive which is applied to the sheet may, of course, be of any suitable type known in the art which will secure the see-through plastic overlay to the sheet and also be covered by a plastic overlay which when removed will still have its adhesive properties. The plastic overlay 60 over the adhesive surface adjacent to the left edge 22 permits insertion into the respective compartments 12*a*′ and 12*a*″ of a photograph, diagram or other visual matter. Once the visual matter is inserted, either in compartment 12*a*′ or 12*a*″, removal of the plastic overlay 60 permits sealing of the left edge 22 by adhesion of the see-through plastic overlay to the underlying sheet. Panel 12*b*, the reverse side of the sheet and backside of panel 12*a*, provides the face of an envelope as shown in FIG. 2.

Panel 13*a* is bound by top edge 20, bottom edge 30, fold line 23 and perforated fold line 25. The sheet provides a surface upon which a corresponding written description relating to the photograph or chart or other visual display can be made. On panel 13*a* and adjacent to the fold line 25 is an adhesive surface covered by a plastic overlay 61. Panel 13*b*, the reverse side of the sheet and the backside of panel 13*a*, provides additional space for written comments as shown in FIG. 2.

Panel 14*a* is bound by top edge 20, bottom edge 30, right edge 24 and fold line 25. Adjacent to the right edge 24 is an adhesive surface covered by a see-through plastic overlay 62. Fold line 25 is formed by a perforated edge which runs from the top edge 20 to the bottom edge 30 and permits detachment of panel 14*a*–14*b*. Panel 14*a* provides a surface on the sheet for a written message on the use of the form. Panel 14*b* provides the face of an envelope as shown in FIG. 2. Approximately one quarter ($\frac{1}{4}$) inch from right edge 24 on rear surface 14*b* is a dotted line 48, see FIG. 2, which is a mark for opening the envelope formed by 14*b*'s face and the rest of the folded form as described below.

Figure 3:
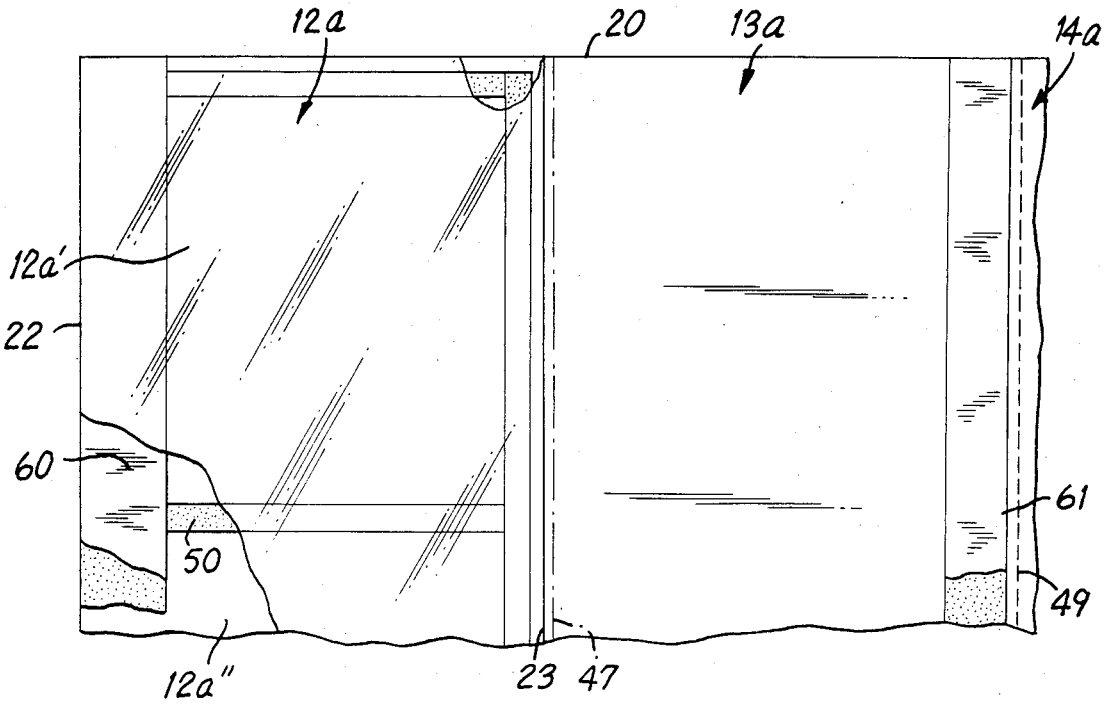
FIG. 3 is an enlarged sectional view of one compartment of the form and the accompanying panel for the corresponding written description.

FIG. 3 provides a detailed view of compartment 12*a*′ and the adjacent space provided by panel 13*a*. As can be seen in this figure, the adhesive surface adjacent to the top, left and fold-line edges 20, 22 and 23 respectively are approximately three-eighths ($\frac{3}{8}$) inches wide, and are illustrative of other width adhesive surfaces which may be used since the specific width of the adhesive surface is not critical. The adhesive surface must be of sufficient width so as to provide adequate surface area to secure the see-through plastic overlay to the underlying sheet. The middle adhesive surface 50 is necessarily wider than the other adhesive surfaces in order to provide adequate surface area for securing the see-through plastic overlay to the undersheet and compartmentalization of panel 12*a* forming 12*a*′ and 12*a*″. The see-through plastic overlay covers the entire area of panel 12*a* in the shape of a rectangle extending from the top edge to the bottom edge, 20 to 30, in length and from the left edge to the fold line, 22 to 23, in width. At the left edge 22 overlying the adhesive surface, is a plastic overlay 60 approximately one (1) inch in width. Thus, at the left edge 22 are four (4) surfaces: at the bottom is the underlying sheet upon which is the adhesive surface which surface is covered by a plastic overlay 60 and topmost is the see-through plastic overlay. Another aspect of the first important feature of the present invention is that the left edge of the see-through plastic overlay can be easily raised since that edge is not attached to the form because of the plastic overlay permitting easy insertion of a photograph or diagram or other visual matter into compartment 12*a*′ or 12*a*″ by simply raising the see-through plastic overlay and sliding the visual matter the overlay. Once the visual matter is in place, the plastic overlay 60 is peeled from the sheet exposing the adhesive surface at the left edge 22. The see-through plastic overlay is pressed to the adhesive surface sealing the left edge and yielding an enclosed compartment 12*a*′ which permits viewing of the photograph, diagram or other visual matter while securing said photograph in the compartment. A similar procedure is followed for placing a visual display in compartment 12*a*''.

Figure 4:
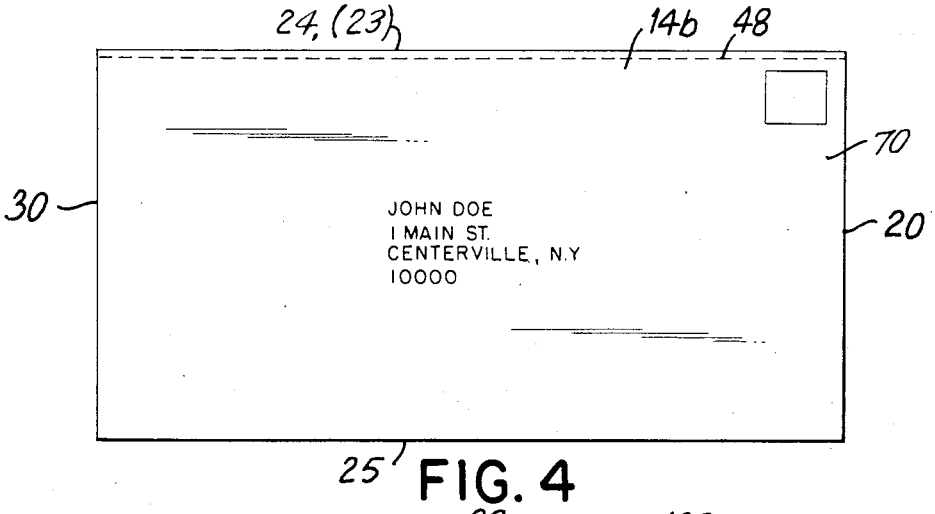
FIG. 4 shows the envelope formed from folding the three panels in accordance with the present invention.

The first envelope is formed by first folding panel 12*a* into coextenisve relation with panel 13*a* along fold line 23. Panel 14*a* is then brought into coextensive relation with panel 12*b* by folding along fold line 25. By removing the plastic overlay 62 before bringing 14*a* into relation with 12*b*, the panel 14*a* may be joined to panel 12*b*. A second important feature of the present invention is that the first envelope 70 is formed by adhesion of the right edge 24 to the fold line 23 thereby envelope 70 is closed along two edges, that formed by the fold line 23 and the right edge 24 and the edge formed by the fold line 25. Once this envelope is received it can be easily opened by tearing along the perforated edge 48 in FIGS. 2 and 4. In accordance with the presently preferred embodiment, once the first envelope 70 is opened and the message imprinted on 14*a* is read panel 14*a*–14*b* can be discarded by tearing along the perforated edge on tear line 49 at the fold line 25. This is suggested in FIG. 1.

Figure 5:
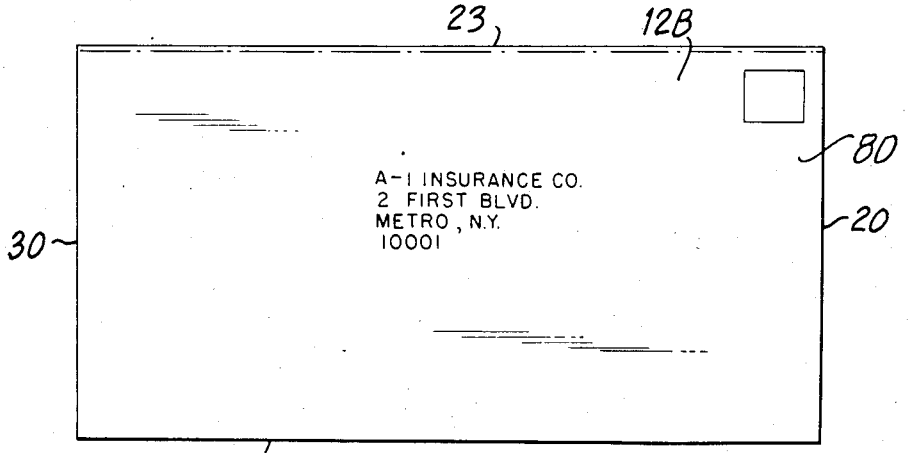
FIG. 5 shows the envelope formed from folding two panels in accordance with the present invention.

Once panels 12*a*, 13*a* and 13*b* are utilized, the form can be folded again by folding panel 12*a* into coextensive relation with panel 13*a*. By removing the plastic overlay 61 before bringing panel 12*a* into relation with panel 13*a*, panel 12*a* may be joined to panel 13*a*. A third important feature of the invention is that the resulting envelope 80, as seen in FIG. 5, is formed by adhesion of the left edge 22 to the fold line 25 thereby envelope 80 is closed along two edges, that formed by the fold line 25 and the left edge 22 and the edge formed by the fold line 23. Upon receipt of the envelope 80 it can be easily opened by cutting along the edge 23 on the line 47.

The insurance form of the present invention is simple in construction and economical to manufacture and yet provides several advantageous features which are desireable in such a business, particularly for providing information on a claim for property damage. However, the invention is not limited to this single application. For example, by omitting panel 14*a*–14*b* the form may be used to secure photographs or visual diagrams in real estate as in the case of a home appraisal. Pictures of the home can be secured and written descriptions and comments can be recorded on panel 13*a*–13*b*. Similarly, in medicine portions of an electrocardiogram can be inserted into compartments 12*a*' and 12*a*'' and physician notes and comments recorded on 13*a*–13*b*. In each case the form may be extended one-half (½) inch beyond the left edge so as to provide a surface for holes or other means of attachment so that the form may be inserted into a file or looseleaf.

While a presently preferred embodiment has been described, it will nevertheless be understood that this is only exemplary and that modifications may be made without departing from the spirit of the invention as defined by the claims that follow. For example, the dimensions of compartments 12*a*' and 12*a*'' are not critical and may be changed by altering the width and/or position of the adhesive surfaces. Thus there may be one compartment, two as described or perhaps three. An alternate embodiment as described above is to extend the left edge 22 one-half (½) inch so as to provide a surface for holes by which the form may be filed or inserted into a binder. Numerous other arrangements using the simple principle of the present invention will become evident to those skilled in the art based on the above disclosure.

What is claimed is:

1. A business form comprising a single sheet utilizing both surfaces of said sheet and divided essentially into a first panel, a second panel and a third panel, whereby said form could be folded to form a first and a second envelope; said first panel on one surface providing a means for securing visual matter such as photographs or diagrams so that the visual matter would be visible after being secured and on the other surface an envelope face; said second panel on both surfaces providing a space for written descriptions and the third panel on one surface providing a space for written matter and on the other surface an envelope face, wherein said first panel is generally equal in width to the second and third panels and having a front and rear surface, bounded by a top, bottom, free edge and a fold line, said first panel having attached to one surface a see-through plastic sheet equal in dimension to said first panel, said first panel including adhesive strips placed along its four edges and apprxoimately in the middle of said first panel said plastic sheet being attached to the first panel along all adhesive strips except the strip which extends along the free edge to form two compartments which are open along the free edge the adhesive strip on the free-edge of said first panel being covered by a plastic overlay, said plastic overlay preventing adhesion of the see-through plastic sheet on the free edge thereby permitting insertion of visual matter through said free edge, and subsequent removal of said plastic overlay from said adhesive strip on said free edge would permit adhesion of said see-through plastic surface to said sheet forming an enclosed compartment to contain said visual matter, said rear surface being the face of an envelope.

2. The form as defined in claim 1, wherein said second panel is generally equal in width to the first and third panels and having front and rear surfaces for written matter, said second panel being separated from the first panel by a fold line and from the third panel by a fold line, said latter fold line being a perforated line, and adjacent ot said latter fold line an adhesive surface being covered by a plastic overlay, said plastic overlay being readily removable.

3. The form as defined in claim 2 wherein the third panel is readily detachable along the perforated line allowing said first and second panels to be used to form said second envelope.

4. The form as defined in claim 3 wherein after the third panel has been detached, the front surface of the first panel is folded into coextensive relation with the front surface of the second panel whereby removal of the overlay from said adhesive strip on the front surface of the second panel operatively secures said first panel to said second panel and forms said second envelope which can be mailed.

5. The form as defined in claim 1, wherein said third panel is generally equal in width to the first and second panels and having a front and rear surface, said front surface containing written matter such as instructions on use of said form, said rear surface being the face of an envelope, said third panel being separated from the second panel by a fold line, said fold line being a perforated line, and adjacent to the free edge of said third panel an adhesive strip, said adhesive strip being covered by a plastic overlay, said plastic overlay being readily removable.

6. The form as defined in claim 1, wherein the front surface of the first panel is folded into coextensive relation with the front surface of the second panel and the front surface of said third panel is folded into coextensive relation with the rear surface of the first panel, said adhesive strip on the front surface of said third panel securing said third panel to the rear surface of said first panel, whereby the folded form becomes a first envelope which can be mailed.

* * * * *